US006119852A

United States Patent [19]

Focke et al.

[11] Patent Number: 6,119,852

[45] Date of Patent: Sep. 19, 2000

[54] HINGE-LID BOX FOR CIGARETTES AND BLANK FOR PRODUCING THE SAME

[75] Inventors: Heinz Focke, Verden; Henry Buse, Visselhövede, both of Germany

[73] Assignee: Focke & Co. (GmbH & Co.), Germany

[21] Appl. No.: 09/315,460

[22] Filed: May 20, 1999

[30] Foreign Application Priority Data

May 29, 1998 [DE] Germany ..... 198 24 281

[51] Int. Cl.[7] ..... A24F 15/00

[52] U.S. Cl. ..... 206/87; 206/102

[58] Field of Search ..... 206/96, 102, 86, 206/242, 264, 265, 268, 271, 273, 85, 87, 246; 229/87.14, 160.1, 120.08, 120.18

[56] References Cited

U.S. PATENT DOCUMENTS

| | | | |
|---|---|---|---|
| 3,866,747 | 2/1975 | Scholz . | |
| 4,193,534 | 3/1980 | Focke et al. | 206/268 |
| 4,252,237 | 2/1981 | Baclit | 206/86 |
| 4,750,613 | 6/1988 | Kopp | 206/87 |
| 5,088,684 | 2/1992 | Torras et al. | 206/87 |
| 5,368,155 | 11/1994 | Ewen | 206/86 |
| 5,558,217 | 9/1996 | Focke et al. | 206/87 |
| 5,918,734 | 7/1999 | Devens et al. | 206/87 |

FOREIGN PATENT DOCUMENTS

| | | |
|---|---|---|
| 0 497 390 A2 | 8/1992 | European Pat. Off. . |
| 80 02 488 U1 | 7/1980 | Germany . |
| 86 10 140 U1 | 8/1987 | Germany . |
| 91 06 739 U1 | 10/1992 | Germany . |
| 296 10 919 U1 | 11/1996 | Germany . |
| 296 13 167 U1 | 3/1997 | Germany . |
| WO 97 38 918 A1 | 10/1997 | WIPO . |

*Primary Examiner*—Paul T. Sewell
*Assistant Examiner*—Luan K. Bui
*Attorney, Agent, or Firm*—Todd Deveau; Troutman Sanders LLP

[57] ABSTRACT

Cuboidal pack made of (thin) cardboard, in particular hinge-lid box, having a box part (11) and a lid (12), it being the case that a sleeve (28) is provided on a box side wall (18), in the region of the box part (11), and encloses a lighter (27) or the like. The sleeve (28) and the parts thereof—flaps (30, 31)—are parts of a blank (10) for the pack. Furthermore, a supporting flap (29), which is also formed from the blank (10), is provided in the plane of a base wall (19).

10 Claims, 5 Drawing Sheets

HINGE-LID BOX FOR CIGARETTES AND BLANK FOR PRODUCING THE SAME

FIELD OF INVENTION

This application is a priority application based upon German patent application 198 24 281.6, filed May 29, 1998;

The invention relates to a cuboidal pack made of (thin) cardboard, in particular a hinge-lid box for cigarettes, comprising a box part and lid, it being the case that the box part, which is formed from a single-piece blank, has a box front wall, a box rear wall, two upright box side walls and a base wall. The invention also relates to blanks for producing hinge-lid boxes.

BACKGROUND OF INVENTION

Hinge-lid boxes or hinge-lid pack are commonly used throughout the world for cigarettes. On the part of the consumers, there is a desire to combine the pack or hinge-lid box with separate articles, to be precise in particular such articles as are used for smoking, that is to say a lighter in particular.

SUMMARY OF INVENTION

The object of the invention is to configure cuboidal packs or hinge-lid boxes of the type mentioned in the introduction such that a separate article, in particular a lighter, can be functionally combined with the pack without the conventional production of packs of this type being made more difficult.

In order to achieve this object, the pack or hinge-lid box according to the invention is characterized in that a securing means for a separate article, in particular for a lighter, is arranged in the region of at least one of the box side walls, the securing means having a sleeve which encloses the separate article and is part of the blank.

The securing means, which according to the invention is arranged on the hinge-lid box and at least partially comprises the blank of the pack, is adapted to the cross-sectional configuration of the usually oval lighter. During the production of the hinge-lid box, the securing means or sleeve is positioned against the box side wall in a folded-down position. When the cigarette pack in opened for the first time, the securing means can be folded open and a lighter can be introduced into it.

A particularly advantageous embodiment is one in which the elements for that securing means are designed and arranged such that blanks for the hinge-lid box can be severed from a material web, or another cut-to-size piece of material, in a waste-free manner. In this case, the flaps of the sleeve or at least one of these flaps are/is produced in part from the region of an (inner) side tab of an adjacent blank.

A further feature of the invention provides a bottom support for the separate article, in particular a supporting flap in the plane of the base wall. The supporting flap is likewise part of the blank for the hinge-lid box, namely part of a base corner tab.

BRIEF DESCRIPTION OF DRAWINGS

Further details of the hinge-lid box according to the invention are explained in more detail hereinbelow with reference to an exemplary embodiment, in which.

DETAILED DESCRIPTION OF DRAWINGS

Figure 2:
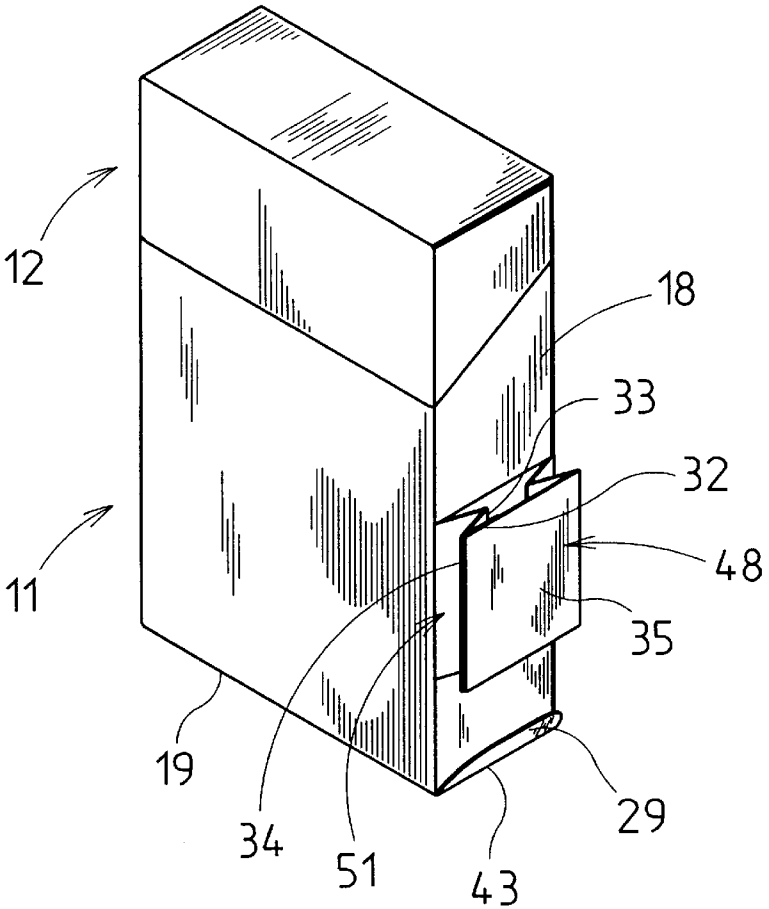
FIG. 2 shows the hinge-lid box according to FIG. 1 with a securing means for the lighter before the latter has been introduced.

The drawings illustrate hinge-lid boxes for cigarettes as the preferred application area. The classic construction of this type of pack comprises a single-piece blank 10 made of thin cardboard. The blank 10 forms a (bottom) box part 11 and a lid 12. The box part 11 and lid 12 are connected to one another, to be precise along a pivot line 13 for connecting a box rear wall 14 to a lid rear wall 15.

Furthermore, the box part 11 comprises a box front wall 16, which is located opposite the box rear wall 14, mutually opposite, upright and comparatively narrow box side walls 17, 18 and a base wall 19.

As is conventional with this type of pack, the box side walls 17, 18 are formed from in each case two mutually overlapping side tabs, namely an inner box side tab 20, 21 and an outer box side tab 22, 23. The inner box side tabs 20, 21 are connected, on mutually opposite sides, to the box rear wall 14 and the other side tabs 22, 23 are connected, on mutually opposite sides, to the box front wall 16.

A further special feature is constituted by corner tabs, namely base corner tabs 24 and 25. These are connected in each case to the associated inner box side tabs 20, 21 and are separated off from the base wall 19 and adjacent outer box side tabs 22, 23 by an L-shaped punch cut 26.

The lid 12 is designed analogously to the box part 11, to be precise in a known manner. A hinge-lid box also usually has a collar (not illustrated), which may comprise a separate blank.

The present pack or hinge-lid box is designed for the addition of, or for securing, a separate article. In the present case, this separate article is a lighter 27. In the case of the exemplary embodiment shown in FIG. 1, a cross-sectionally oval (disposable) lighter 27 is connected to the pack or hinge-lid box in a removable manner.

For this purpose, a securing means is provided on a box side wall 18, approximately halfway up the box part 11. Said securing means comprises a sleeve 28, that is to say a material strip, which encloses the lighter 27 halfway up in a more or less form-fitting manner. The securing means also has a bottom support, which in this case is designed so a supporting flap 29 in the plane of the base wall 19.

The sleeve 28 is part of the blank 10 for the hinge-lid box, that is to say is connected integrally to said blank 10. The sleeve 28 comprises two flaps 30, 31, which overlap one another by way of end regions and are connected to one another, for example by adhesive bonding, in the region of a resulting overlap 32.

Figure 1:
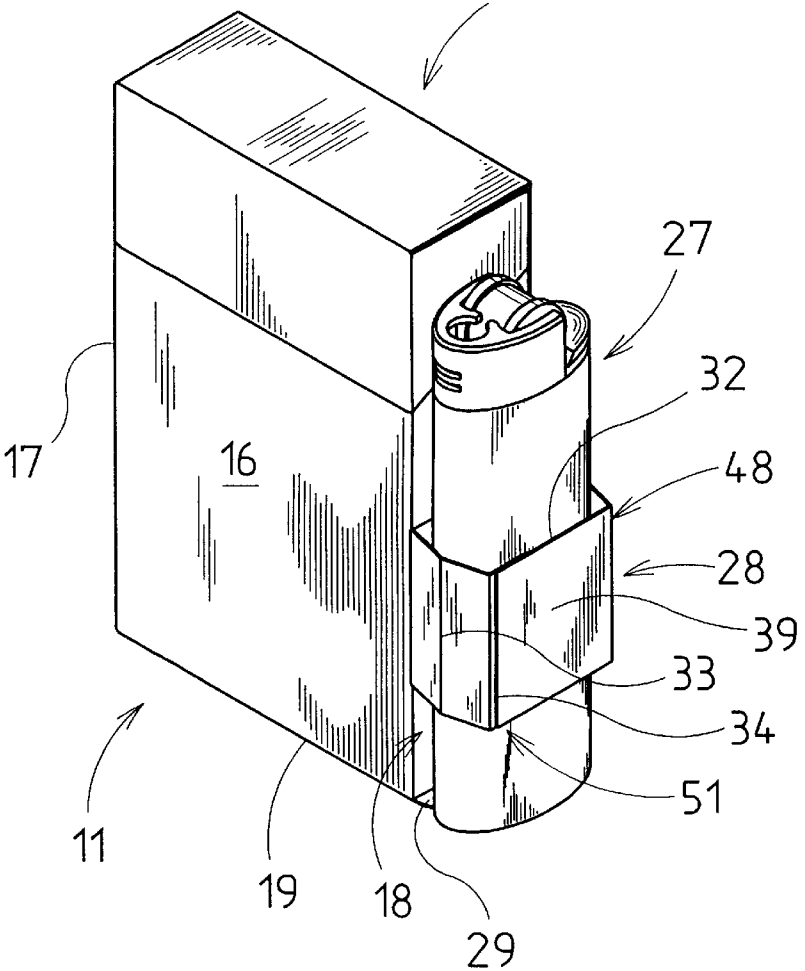
FIG. 1 shows a perspective illustration of a pack, namely hinge-lid box, with lighter.
Figure 3:
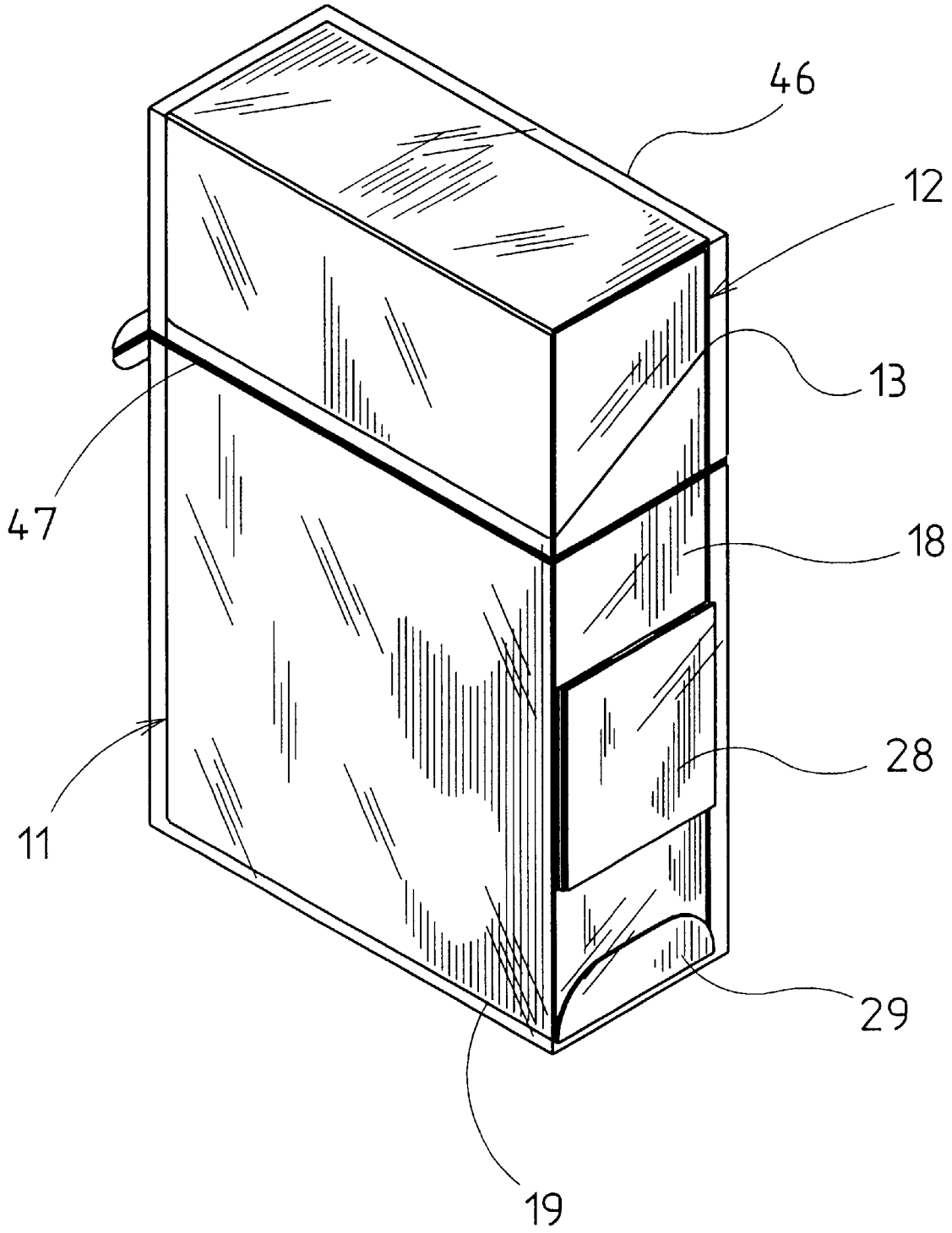
FIG. 3 shows a hinge-lid box according to FIGS. 1 and 2 with an outer wrapper before the box has been opened for the first time.

The blank for producing hinge-lid boxes with securing means may be designed in various ways. According to FIG. 4, the flaps 30, 31 for forming the sleeve 28 are designed to correspond to one another and each have two parallel folding lines 33, 34. The latter extend in the region of side parts of the sleeve 28. When the sleeve 28 is in the use position (FIG. 1). The folding lines 33, 34 ensure form-fitting adaptation to the cross-sectional configuration of the lighter 27 by polygonal folding of the sleeve 28 in this region. In an initial position, namely before the pack has been opened for the first time, or also for the case where a lighter 27 or some other article has not been provided on the pack, the securing means or sleeve 28 can be folded down so as to butt closely against the box side wall 18 (FIGS. 2 and 3). In this case, material strips bounded by the folding lines 33, 34 are folded inwards in the form of an M. An outer transverse wall 35 corresponds here approximately to the width of the box side wall 18, with the result that the sleeve 28 abuts without projecting.

The sleeve 28 and the flaps 30, 31 thereof are part as the inner and outer box side tabs 20, 22. The flaps 30, 31 are separated off from the rest of the region of the box side tabs 20, 22 by transversely directed punch lines 36, 37. The flaps 30, 31 each project, by way of a projection 38, 39, beyond the box side tabs 20, 22 and thus beyond the contour of the blank 10. The punch lines 36, 37 extend up to folding lines 40, 41 for defining upright pack edges on the front and rear sides. The folding lines 40, 41 also allow the flaps 30, 31 to pivot. A recess is produced in the box side wall 18 beneath the flaps 30, 31. The pack contents, namely a cigarette block, that is to say a cigarette group wrapped in an inner blank, are/is exposed here.

The supporting flap 29 is likewise part of the blank 10, to be precise part of the bass corner tab 24 on the side directed towards the box side wall 18. A more or less U-shaped or similarly designed punch card 42 defines the supporting flap 29 as a part or continuation of the base wall 19. The surface area of the associated base corner tab 24 is reduced correspondingly. While, when the pack is finished, the base corner tabs 24, 25 are folded against the base wall 19 on the inside, the supporting flap 29 extends outside the hinge-lid box as a continuation of the base wall 19. The supporting flap 29 can be folded against the box side wall 18 on the outside by way of a folding line 43 (FIGS. 2 and 3).

In this position (FIG. 3), the hinge-lid box is enclosed, as is usually the case, by an outer wrapper 46 made of film material. Said wrapper fixes the securing means, namely the sleeve 28 on the one hand and the supporting flap 29 on the other hand, in close abutment against the box side wall 18. Once the outer wrapper 46 has been removed—by manipulation of a tear-open strip 47—the exposed securing means, namely sleeve 28 and supporting flap 29, can be folded into the functional position (FIG. 1).

Figure 4:
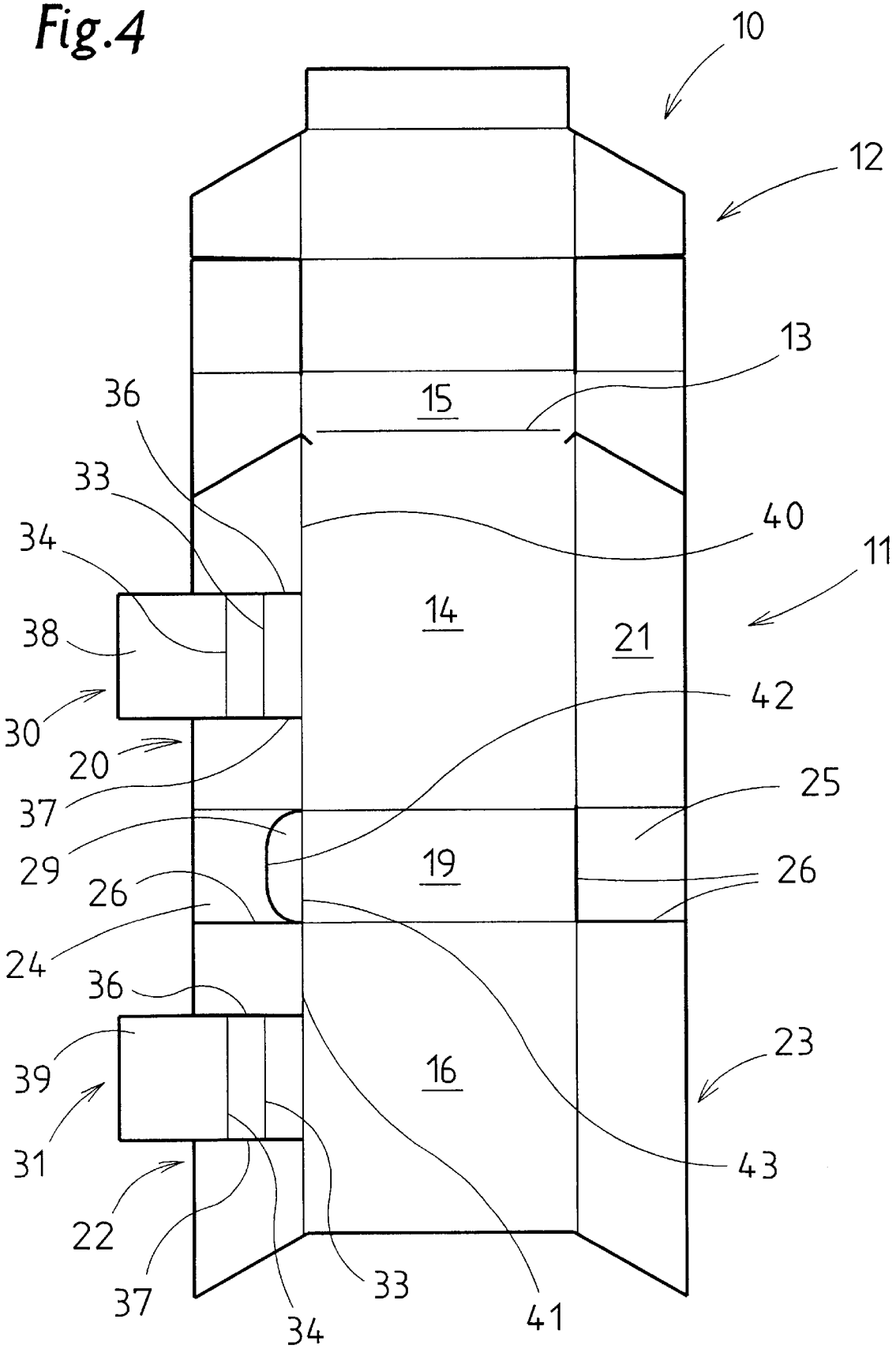
FIG. 4 shows a blank for a hinge-lid box according to FIGS. 1 and 2.

During the production of blanks according to FIG. 4, these blanks are positioned, within a material web or a cut-to-size piece, at intervals which correspond to the projection formed by the flaps 30, 31. Waste material is thus produced between the blanks 10.

Figure 5:
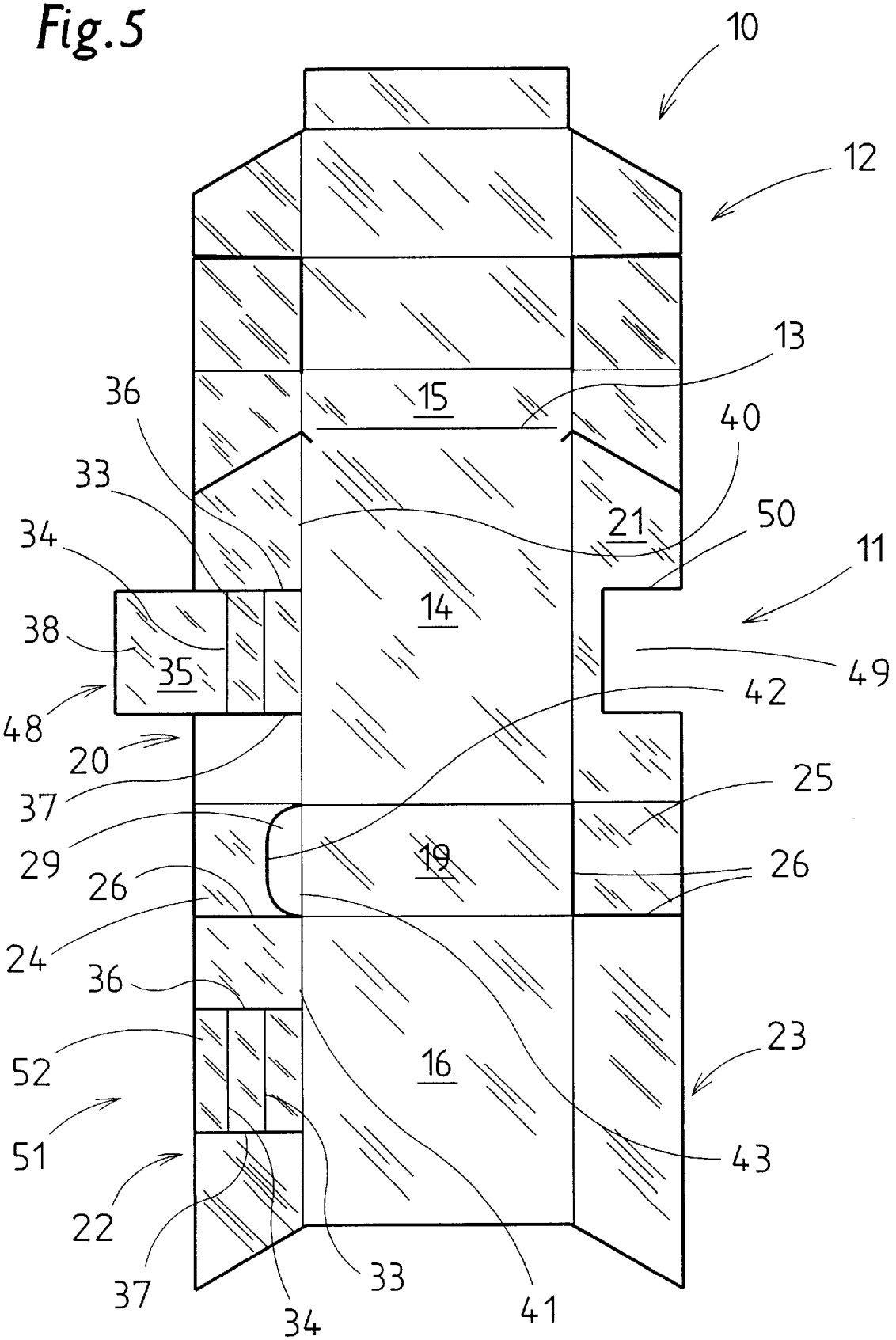
FIG. 5 shows another embodiment of a blank for a hinge-lid box.

A blank according to FIG. 5 is more advantageous as far as material consumption is concerned. A special feature is that a first flap 48, as part of the sleeve 28, corresponds with a recess 49 which is arranged in the region of the opposite box side tab 21. The dimensions and contours of the recess 49 correspond to the projection 38 formed by the flap 48.

Figure 6:
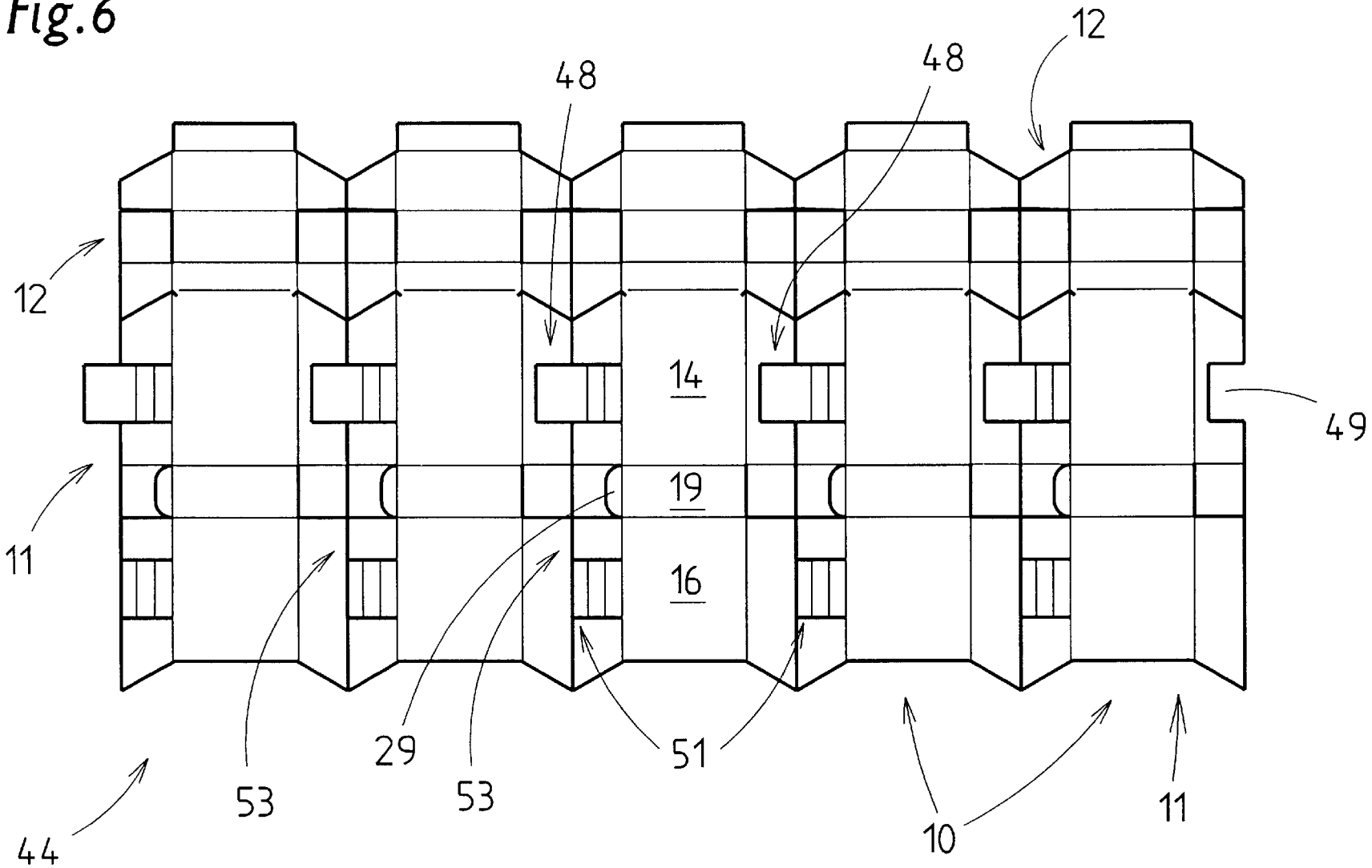
FIG. 6 shows a series of blanks according to FIG. 5 as part of a continuous material web.

The blank 10 designed in this way may be positioned within a material web (FIG. 6) or a cut-to-size piece in a waste-free manner. The projection 36 formed by the flap 48 fits into the recess 49 of an adjacent blank 10. When the blanks are severed, a U-shaped punch cut 50 is performed in the region of the flap 48, such cut, on the one hand, forming the recess 49 and, on the other hand, separating off the flap 48 from the adjacent blank 10. Accordingly, the blanks 10 are severed from the adjacent blank 10 by a transversely directed severing cut 53. The severing cut 53 is preferably performed so as simultaneously to produce the flap 48 along with the formation of the recess 49 by the U-shaped punch cut. Furthermore, the flap 51 is expediently produced at the same time by transversely directed punch cuts, as is the supporting flap 29 in region of the base corner tab 24. The severing cut 53 defines, at the same time, the free borders of the blanks 10.

In the case of this exemplary embodiment, a second flap 51, as part of the sleeve 28, is designed with smaller dimensions in the transverse direction of the blank 10, namely flush with the blank 10 or the (outer) box side tab 22. The outer, free border of said flap 51 is thus produced by the transversely directed severing cut 53, and otherwise by the punch lines 36, 37. The opposite (outer) box side tab 23 remains intact and, when the hinge-lid box is finished, thus overlaps the recess 49 of the inner box side tab 21.

In order to form the sleeve 28, an outer border strip 52, which is bounded by the folding line 34, is connected to the flap 48 on the inside, namely to the transverse wall 35 of said flap. Accordingly, the latter is formed exclusively by the (longer) flap 48 or by the projection 38 thereof.

It is also possible for a securing means of the type described to be provided on both sides of the pack. It is also possible for the securing means or the individual parts thereof to be designed such that other articles, for example a cigarette holder, lipstick or the like, may be provided on the pack in an analogous manner.

What is claimed is:

1. A cuboidal hinge-lid cigarette box made of a single-piece of a single sheet blank (10) of cardboard comprising a lid (12) and a box part (11) which has a box front wall (16) interconnected to a box rear wall (14) by two upright side walls (17, 18), each wall having a bottom portion which is connected to a base wall (19), said box part (11) having a sleeve (28) formed from the blank (10) for carrying a cigarette lighter adjacent to at least one of the box side walls (17, 18), said sleeve comprising two sleeve flaps (30, 31, 48, 51) which are secured by securing means in an overlapped position.

2. The cigarette box of claim 1, wherein the securing means is an adhesive.

3. The cigarette box of claim 1, wherein the side wall (17, 18) to which the sleeve (28) is adjacent is comprised of an inner side tab (20) and an overlying outer side tab (22) with a sleeve (28) comprised of two flaps (30, 31, 48, 51), with one of said sleeve flaps being formed from the outer side tab (22), and the other sleeve flap bring formed from the inner side tab (20).

4. The cigarette box of claim 3, wherein the sleeve flaps (30, 31, 48, 51) are formed by cut lines (36, 37) perpendicular to the front wall (16) in strip-like regions of the mutually associated box side tabs (20, 22), and at least one sleeve flap (30, 48) has a projection (38, 39), which projects beyond the side tab (20, 22) for use in securing the sleeve flaps (30, 31, 48, 51) to one another.

5. The cigarette box of claim 3, wherein the sleeve flaps (48, 51) are of different dimensions lengths, with the longer sleeve flap (48) forming the outer sleeve flap and the other shorter sleeve flap (51) forming the inside sleeve flap, said inside flap being secured by securing means to the longer sleeve flap (48).

6. The cigarette box of claim 5, wherein the shorter sleeve flap (51) is formed from the outer side tab (22) and terminates flushed with the end of said tab.

7. The cigarette box of claim 1, wherein a supporting flap 29 is provided as a continuation of the base wall (19) adjacent the side wall to which the sleeve is adjacent, said supporting flap being capable of supporting the cigarette lighter.

8. The cigarette box of claim 7, wherein the supporting flap 29 is connected to a base corner tab (24), which in turn is connected to the inner side tab (20).

9. The cigarette box of claim 5, wherein the side wall (17, 18) opposite the side wall in which the sleeve (28) is formed has an inner side tab (21) with a recess (49) corresponding in size and position to the projection of the longer sleeve flap (48).

10. A web of a single sheet of cardboard with a plurality of blanks, each said blank having the cigarette box structure as defined in claim 9, wherein the blanks are located side-by-side in close proximity in which the shorter sleeve flap (51) is flush with the edge of the outer side tab (22) and the longer sleeve flap fits into the recess (49) of the inner side tab (21) of an adjacent blank.

* * * * *